US007750547B2

(12) United States Patent
Jeon et al.

(10) Patent No.: US 7,750,547 B2
(45) Date of Patent: Jul. 6, 2010

(54) ELECTRON EMISSION DEVICE WITH REDUCED DETERIORATION OF SCREEN IMAGE QUALITY

(75) Inventors: Sang-Ho Jeon, Suwon-si (KR); Byong-Gon Lee, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 418 days.

(21) Appl. No.: 11/349,953

(22) Filed: Feb. 9, 2006

(65) Prior Publication Data

US 2006/0266994 A1 Nov. 30, 2006

(30) Foreign Application Priority Data

May 31, 2005 (KR) ..... 10-2005-0046199

(51) Int. Cl.
*H01J 1/90* (2006.01)

(52) U.S. Cl. ..... 313/495; 313/310; 313/496

(58) Field of Classification Search ..... None
See application file for complete search history.

(56) References Cited

U.S. PATENT DOCUMENTS

| | | | | |
|---|---|---|---|---|
| 5,851,133 | A | 12/1998 | Hofmann | |
| 5,945,780 | A | 8/1999 | Ingle et al. | |
| 5,980,346 | A | 11/1999 | Anderson et al. | |
| 5,989,404 | A | 11/1999 | Kiyomiya et al. | |
| 6,008,573 | A * | 12/1999 | Beeteson et al. | 313/422 |
| 6,414,428 | B1 | 7/2002 | Schropp, Jr. et al. | |
| 2003/0071553 | A1 * | 4/2003 | Ryu et al. | 313/292 |
| 2003/0197459 | A1 | 10/2003 | Takenaka et al. | |
| 2004/0104655 | A1 * | 6/2004 | Kodera et al. | 313/292 |
| 2004/0232823 | A1 * | 11/2004 | Nakata et al. | 313/495 |

FOREIGN PATENT DOCUMENTS

| | | |
|---|---|---|
| CN | 1 503 308 A | 6/2004 |
| EP | 0 616 354 | 9/1994 |
| EP | 1 478 005 | 11/2004 |

* cited by examiner

*Primary Examiner*—Joseph L Williams
*Assistant Examiner*—Fatima N Farokhrooz
(74) *Attorney, Agent, or Firm*—Lee & Morse, P.C.

(57) ABSTRACT

An embodiment of an electron emission device includes first and second substrates facing each other, unit pixels being defined on the first and the second substrates, an electron emission unit on the first substrate, phosphor layers on a surface of the second substrate facing the first substrate, each phosphor layer corresponding to at least one unit pixel, non-light emission regions between the phosphor layers, and spacers interposed between the first and the second substrates and arranged in the non-light emission regions, wherein the non-light emission regions comprise spacer loading regions loaded with the spacers, wherein a width of a spacer loading region and a pitch of the unit pixels satisfies the following condition: A/B≧about 0.2, where A indicates the width of the spacer loading region and B indicates the pitch of the unit pixels located along the width of the spacer loading region.

17 Claims, 6 Drawing Sheets

ELECTRON EMISSION DEVICE WITH REDUCED DETERIORATION OF SCREEN IMAGE QUALITY

BACKGROUND OF THE INVENTION

1. Field of the Invention

The present invention relates to an electron emission device. In particular, the present invention relates to an electron emission device having a spacer loading region, in which the width of the spacer loading region is defined to reduce the deterioration of screen image quality due to charging of spacers.

2. Description of Related Art

Generally, electron emission devices are classified into those using hot cathodes as the electron emission source, and those using cold cathodes as the electron emission source. There are several types of cold cathode electron emission devices, including a field emitter array (FEA) type, a metal-insulator-metal (MIM) type, a metal-insulator-semiconductor (MIS) type and a surface conduction emitter (SCE) type.

The MIM type and the MIS type electron emission devices have electron emission regions with a metal/insulator/metal (MIM) structure and a metal/insulator/semiconductor (MIS) structure, respectively. When voltages are applied to the two metals, or the metal and the semiconductor, on either side of the insulator, electrons migrate from the high electric potential metal or semiconductor to the low electric potential metal, where the electrons are accumulated and emitted.

The SCE type electron emission device includes a thin conductive film formed between first and second electrodes arranged facing each other on a substrate. High resistance electron emission regions or micro-crack electron emission regions are positioned on the thin conductive film. When voltages are applied to the first and second electrodes and an electric current is applied to the surface of the conductive film, electrons are emitted from the electron emission regions.

The FEA type electron emission device uses electron emission regions made from materials having low work functions or high aspect ratios. When exposed to an electric field in a vacuum atmosphere, electrons are easily emitted from these electron emission regions. Electron emission regions having a sharp front tip structure based on molybdenum (Mo) or silicon (Si) have been used. Also, electron emission regions including carbonaceous materials, such as carbon nanotubes, have been used.

Although the different types of electron emission devices have specific structures, they basically have first and second substrates sealed to each other to form a vacuum vessel, spacers arranged between the first and second substrates, electron emission regions formed on the first substrate, driving electrodes for controlling the emission of electrons from the electron emission regions, phosphor layers formed on a surface of the second substrate facing the first substrate, and an anode electrode for accelerating the electrons emitted from the electron emission regions toward the phosphor layers, thereby causing light emission to generate the display.

The spacers support the vacuum vessel to prevent it from being distorted and broken, and maintain a constant distance between the first and the second substrates. The spacers may be located corresponding to the non-light emission regions between the respective phosphor layers, such that they do not intercept electrons moving from the electron emission regions toward the phosphor layers.

However, in practice, given the practical trajectories of electron beams during the operation of the electron emission device, some of the electrons emitted from the electron emission regions do not move straight from the electron emission regions toward the phosphor layers at the corresponding pixels, but instead diffuse toward the non-light emission regions or toward incorrect phosphor layers at the pixels neighboring the target pixels.

These stray electrons may collide against the surfaces of the spacers, which, in turn, may develop an electrical charge, e.g., a positive potential or a negative potential, depending upon the spacer material. The surface-charged spacers may distort the trajectories of electron beams, resulting in a deterioration of display uniformity around the spacers and unintended light emission from the neighboring phosphor layers, resulting in an overall deterioration of screen image quality.

SUMMARY OF THE INVENTION

The present invention is therefore directed to an electron emission device, a display device and a method of manufacturing, which substantially overcome one or more of the problems due to the limitations and disadvantages of the related art.

It is therefore a feature of an embodiment of the present invention to provide an electron emission device that minimizes abnormal light emission and the deterioration of display uniformity around spacers.

It is therefore another feature of an embodiment of the present invention to provide an electron emission device that minimizes the effects of surface-charged spacers on the trajectory of emitted electrons.

At least one of the above and other features and advantages of the present invention may be realized by providing an electron emission device including first and second substrates facing each other, unit pixels being defined on the first and the second substrates, an electron emission unit on the first substrate, phosphor layers on a surface of the second substrate facing the first substrate, each phosphor layer corresponding to at least one unit pixel, non-light emission regions between the phosphor layers, and spacers interposed between the first and the second substrates and arranged in the non-light emission regions, wherein the non-light emission regions include spacer loading regions loaded with the spacers, wherein a width of a spacer loading region and a pitch of the unit pixels satisfy the following condition: $A/B \geqq$ about 0.2, where A indicates the width of the spacer loading region and B indicates the pitch of the unit pixels located along the width of the spacer loading region.

The width of the spacer loading region and the pitch of the unit pixels may satisfy the following condition: $A/B \leqq$ about 0.5, where A indicates the width of the spacer loading region and B indicates the pitch of the unit pixels located along the width of the spacer loading region. Black layers may be formed at the non-light emission regions and the width of the spacer loading region may correspond to a width of a black layer. Unit pixels may be arranged along horizontal and the vertical sides of the second substrate, and the spacers may be disposed between the phosphor layers located along the vertical side of the second substrate, with the width of the spacer loading region and the pitch of the unit pixels being determined along the vertical side of the second substrate. The spacers may have a wall shape or a pillar shape.

At least one of the above and other features and advantages of the present invention may also be realized by providing a display device including a first substrate including electron emission elements, a second substrate facing the first substrate, the second substrate including a regular pattern arranged in a first direction, the regular pattern having spacer loading regions disposed between adjacent light emission regions, the spacer loading regions having a first length in the first direction and the light emission regions having a second length in the first direction, wherein the regular pattern has a pitch in the first direction equal to the sum of the first length and the second length, and wherein the first length is greater than or equal to about one-fifth of the pitch, and spacers disposed in the spacer loading regions.

The first length may be less than or equal to about one-half of the pitch. The pitch may correspond to a vertical direction of the display device. Each light emission region may include three different colored-light emission elements arranged in a second direction, the second direction substantially orthogonal to the first direction. The second direction may correspond to a horizontal direction of the display device. The display device may include non-light emission regions corresponding to the spacer loading regions. The non-light emission regions may be black layers.

At least one of the above and other features and advantages of the present invention may further be realized by providing a method of manufacturing a display device including forming phosphor layers on a surface of a substrate, each phosphor layer corresponding to at least one unit pixel, forming non-light emission regions between the phosphor layers, and arranging spacers in spacer loading regions, the spacer loading regions located in the non-light emission regions, wherein a width of a spacer loading region and a pitch of the unit pixels satisfy the following condition: $A/B \geqq$ about 0.2, where A indicates the width of the spacer loading region and B indicates the pitch of the unit pixels located along the width of the spacer loading region.

The width of the spacer loading region and the pitch of the unit pixels may satisfy the following condition: $A/B \leqq$ about 0.5, where A indicates the width of the spacer loading region and B indicates the pitch of the unit pixels located along the width of the spacer loading region. The method may also include forming black layers at the non-light emission regions. The width of the spacer loading region may correspond to a width of a black layer.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
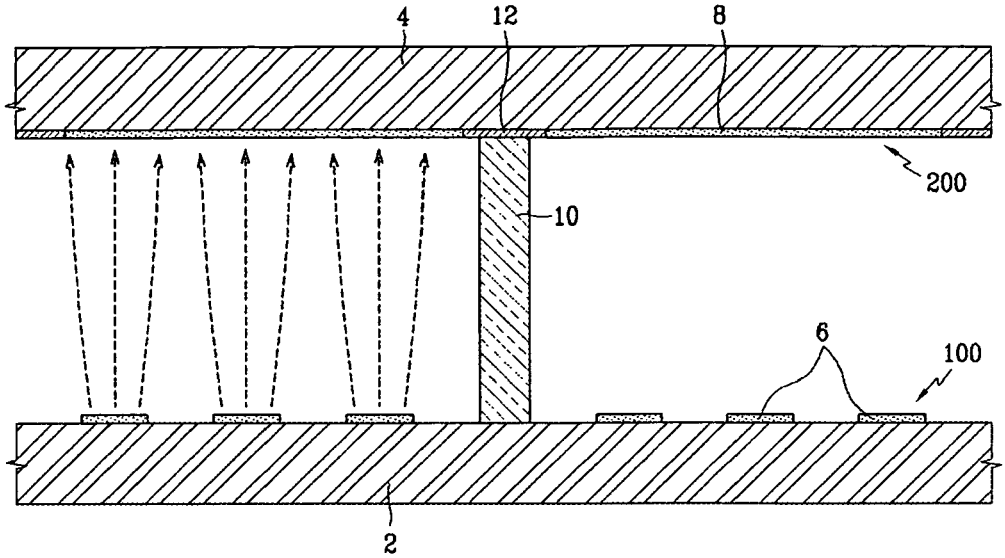
FIG. 1 illustrates a partial sectional view of an electron emission device according to an embodiment of the present invention.

Korean Patent Application No. 10-2005-0046199, filed on May 31, 2005, in the Korean Intellectual Property Office, and entitled: "Electron Emission Device," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

As illustrated in FIG. 1, an electron emission device may include first substrate 2 and second substrate 4 arranged parallel to each other and separated by a predetermined distance. A sealing member (not shown) may be provided at the peripheries of the first substrate 2 and the second substrate 4 to form an evacuated inner space (vacuum chamber) between the two substrates.

An electron emission unit 100 may be provided on a surface of the first substrate 2 facing the second substrate 4 to emit electrons toward the second substrate 4. A light emission unit 200 may be provided on the surface of the second substrate 4 facing the first substrate 2 to emit visible light in response to the emitted electrons, thereby generating a light emission or display.

The electron emission unit 100 may include a plurality of electron emission regions 6 and driving electrodes (not shown) for controlling the emission of electrons from the electron emission regions 6. One or more electron emission regions 6 may be provided at respective unit pixels defined on the first substrate 2. The electron emission regions 6 may be controlled by the driving electrodes, which may turn on or off, or control the amount of, electron emission of the respective unit pixels.

The light emission unit 200 may include phosphor layers 8 spaced apart from each other by a predetermine distance, and may include non-light emission regions between the respective phosphor layers 8. The phosphor layers 8 may be separately formed at the respective unit pixels defined on the second substrate 4, or phosphor layers 8 may extend over two or more unit pixels. The unit pixels defined on the first substrate 2 and the unit pixels defined on the second substrate 4 correspond to each other in the direction of the thickness of electron emission device (in the direction of the z axis of the drawing).

A plurality of spacers 10 may be arranged at the non-light emission regions between the first substrate 2 and the second substrate 4 (for clarity, only one spacer is illustrated). The non-light emission regions having the spacers 10 may be defined as the spacer loading regions 12. Electron beams may be distorted at the spacer loading regions 12 due to the charging of the spacers 10 during the operation of the electron emission device.

In an electron emission device according to an embodiment of the present invention, the dimension of the spacer loading region 12 is defined in consideration of the arrangement of the unit pixels defined on the first substrate 2 or the second substrate 4, thereby reducing or eliminating the deterioration of the screen image quality due to the distortion of electron beams due to charging of the spacers. The structure of an electron emission unit, a light emission unit and a spacer loading region according to the present invention will be now explained with reference to an FEA type electron emission device using the cold cathode.

Figure 2:
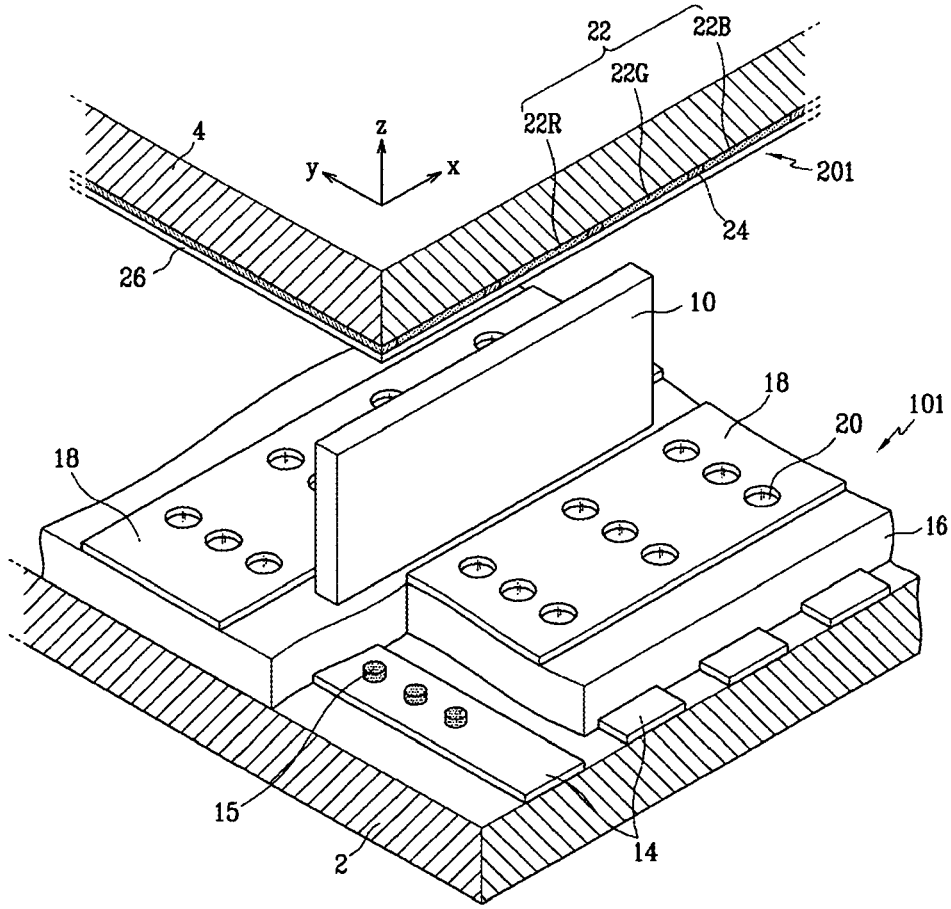
FIG. 2 illustrates a partial exploded perspective view of an FEA type electron emission device according to an embodiment of the present invention.
Figure 3:
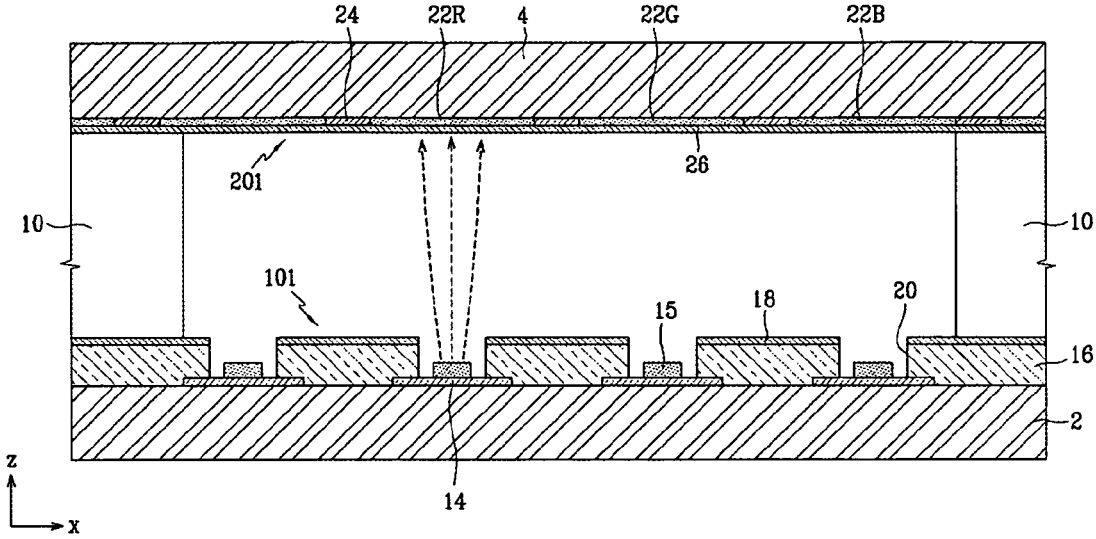
FIGS. 3 and 4 illustrate partial sectional views of the FEA type electron emission device of FIG. 2.
Figure 4:
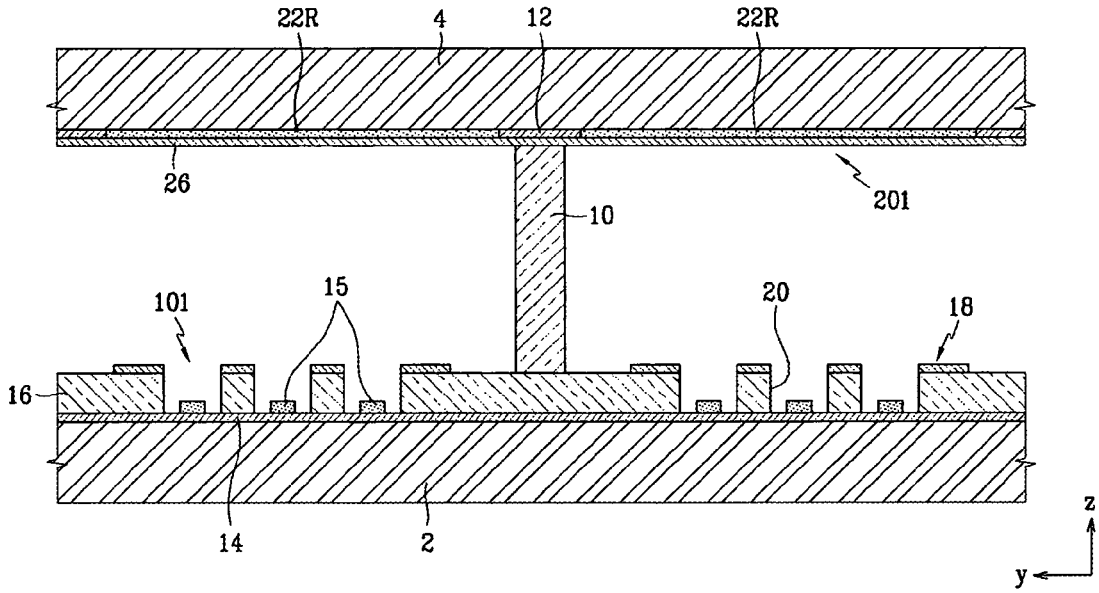

As illustrated in FIGS. 2 to 4, the electron emission unit 101 may include cathode electrodes 14 in, e.g., a striped pattern, on the first substrate 2 and arranged in a direction parallel to the first substrate 2, an insulating layer formed on the entire surface of the first substrate 2 and covering the cathode electrodes 14, and gate electrodes 18 in, e.g., a striped pattern, on the insulating layer 16 and arranged in a direction parallel to the first substrate to and perpendicular to the cathode electrodes 14.

The crossed regions of the cathode electrodes 14 and the gate electrodes 18 form unit pixels. One or more electron emission regions 15 may be provided over the cathode electrodes 14 at the respective unit pixels. Openings 20 may be formed at the insulating layer 16 and the gate electrodes 18 corresponding to the respective electron emission regions 15 and exposing the electron emission regions 15 on the first substrate 2.

The electron emission regions 15 illustrated in the figures have a circular plane shape and are arranged along the length of the cathode electrodes 14 per the respective unit pixels. However, the plane shape, number per unit pixel, and arrangement of the electron emission regions 15 are not limited to the illustrated example and may be altered in various ways.

The electron emission regions 15 may be formed with a material emitting electrons under the application of an electric field, e.g., a carbonaceous material, a nanometer-sized material, etc. The electron emission regions 15 may be formed with, e.g., carbon nanotube, graphite, graphite nanofiber, diamond, diamond-like carbon, C60, silicon nanowire, etc., or a combination thereof, and may be formed by screen-printing, direct growth, chemical vapor deposition, sputtering, etc.

In a device having the structure described above, the cathode electrodes 14 may be electrically connected to the electron emission regions 15 to apply an electric current to the electron emission regions to cause electron emission. The gate electrodes 18 may form electric fields around the electron emission regions 15, using a voltage difference between the gate electrodes 18 and the cathode electrodes 14, resulting in the emission of electrons from the electron emission regions 15. That is, the cathode electrodes 14 and the gate electrodes 18 may serve as the driving electrodes for controlling the emission of electrons.

Figure 5:
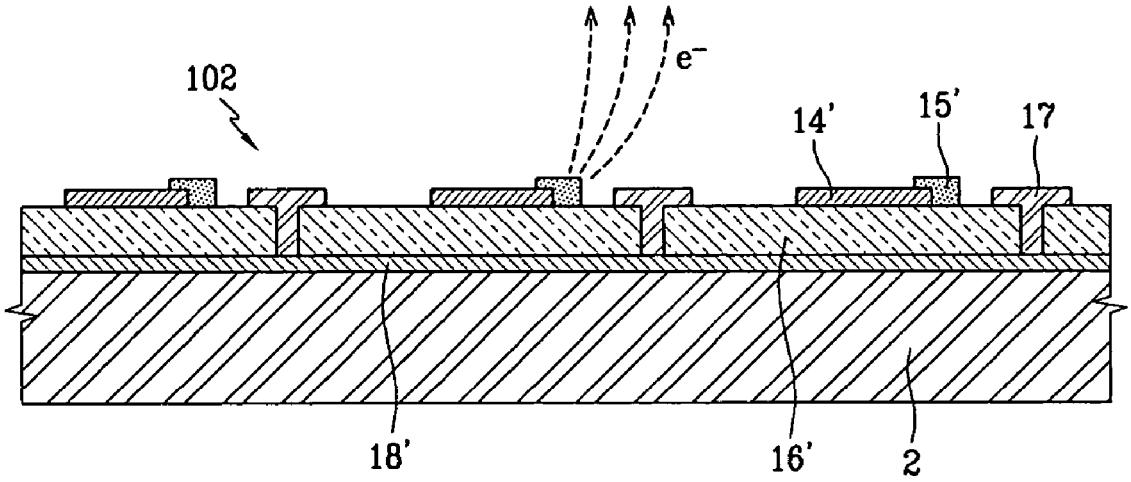
FIG. 5 illustrates a partial sectional view of an electron emission unit for the FEA type electron emission device according to another embodiment of the present invention.

In another embodiment, as illustrated in FIG. 5, cathode electrodes 14' and gate electrodes 18' may be interchanged. In the electron emission unit 102, the gate electrodes 18' may first be formed on the first substrate 2, and an insulating layer 16' may be formed on the entire surface of the first substrate 2, covering the gate electrodes 18'. Cathode electrodes 14' may then be formed on the insulating layer 16'.

Electron emission regions 15' may be formed on the insulating layer 16' and may contact lateral surfaces of the cathode electrodes 14'. Counter electrodes 17 may be electrically connected to the gate electrodes 18' while being spaced apart from the electron emission regions 15' between the cathode electrodes 14'. The counter electrodes 17 may serve to pull the electric fields of the gate electrodes 18' over the insulating layer 16' to form strong electric fields around the electron emission regions 15'.

Returning to the embodiment illustrated in FIGS. 2 to 4, the light emission unit 201 may include red, green and blue phosphor layers 22R, 22G and 22B formed on a surface of the second substrate 4 facing the first substrate 2, with non-light emission regions between the respective phosphor layers 22. The phosphor layers 22 are not present in the non-light emission regions, and, for all practical purposes, visible light is not emitted from the non-light emission regions. Black layers 24 may be formed at the non-light emission regions with, e.g., chromium or chromium oxide, to enhance the screen contrast.

An anode electrode 26 may be formed on the phosphor layers 22 and the black layers 24 with, e.g., a metallic material such as aluminum. The anode electrode 26 receives a high voltage required for accelerating the electron beams, and during the operation of the electron emission device, may reflect the visible light radiated from the phosphor layers 22 toward the first substrate 2 back toward the second substrate 4 to heighten the screen luminance.

Figure 6:
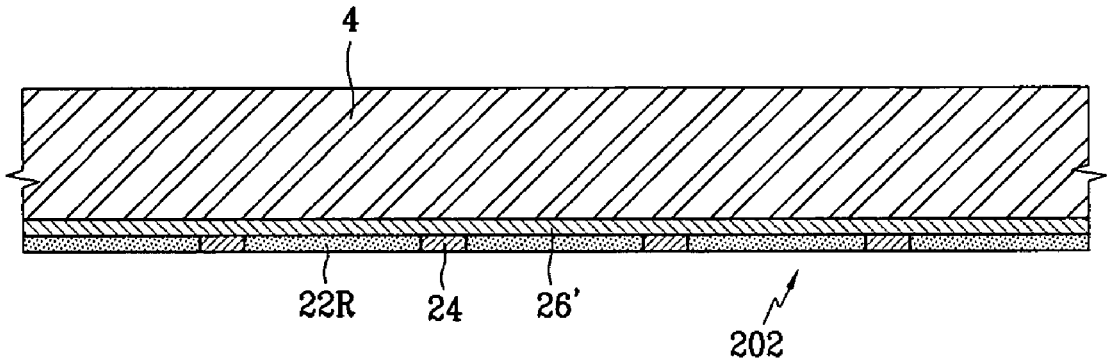
FIG. 6 illustrates a partial sectional view of a light emission unit for the FEA type electron emission device of FIG. 2.

In another embodiment, illustrated in FIG. 6, an anode electrode 26' may first be formed on a surface of the second substrate 4 and phosphor layers 22 and black layers 24 may then be formed on the anode electrode 26'. The anode electrode 26' may be formed of a transparent conductive material such as indium tin oxide (ITO) such that it transmits visible light radiated from the phosphor layers 22. Reference numeral 202 of FIG. 6 refers to the light emission unit.

Figure 7:
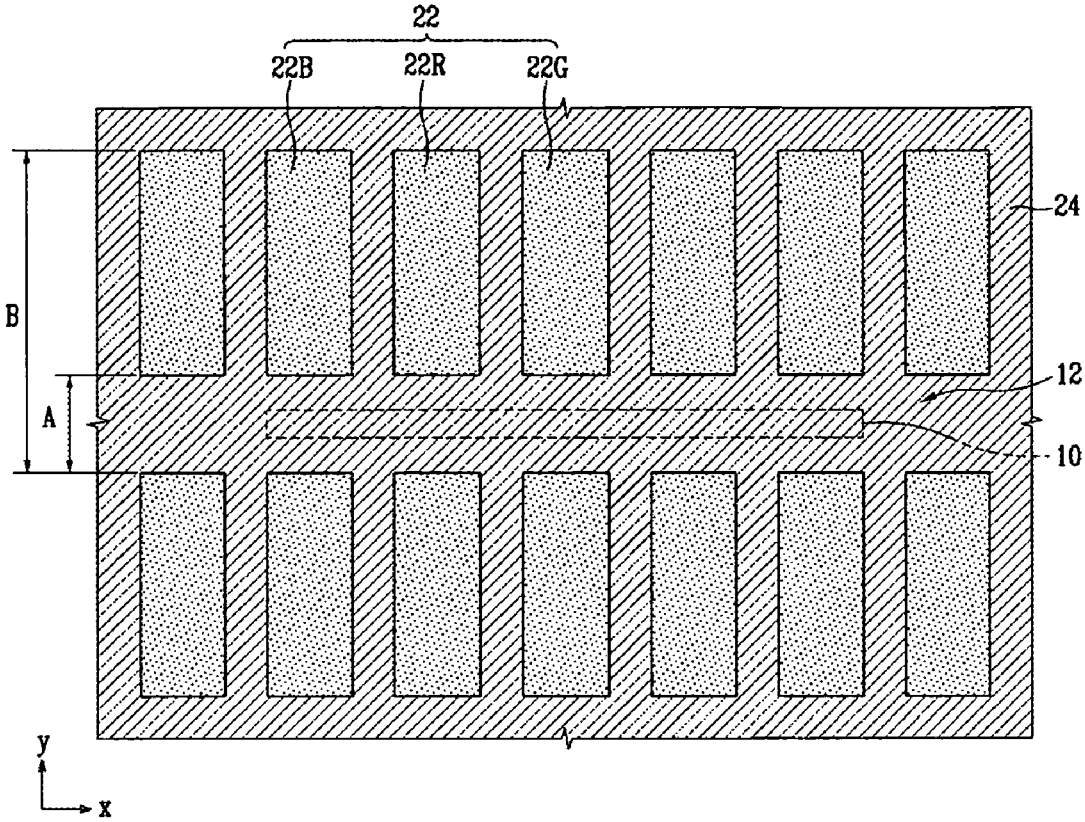
FIG. 7 illustrates a partial plan view of the FEA type electron emission device of FIG. 2.

Unit pixels may also be defined on the second substrate 4 corresponding to the unit pixels defined on the first substrate 2. FIG. 7 illustrates a partial plan view of the FEA type electron emission device of FIG. 2, illustrating details of a structure where one phosphor layer 22 is separately formed at each unit pixel defined on the second substrate 4.

Spacers 10 may be arranged between the first substrate 2 and the second substrate 4 to maintain a constant distance between the first substrate 2 and the second substrate 4 and to support the vacuum vessel, so as to prevent the distortion and breakage thereof.

Figure 8:
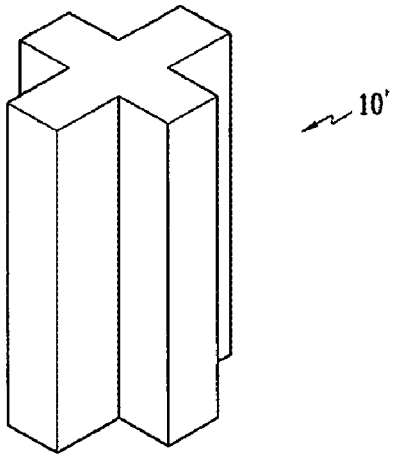
FIG. 8 illustrates a perspective view of a pillar-shaped spacer.

The spacers 10 may be wall shaped, i.e., having a rectangular aspect and oriented perpendicular to the first substrate 2 and the second substrate 4, and may be arranged between and aligned parallel to the gate electrodes 18. Alternatively, the spacers may be shaped as a pillar, e.g., a cross pillar 10', as illustrated in FIG. 8. As illustrated in FIG. 7, the spacers 10 may be positioned between the phosphor layers 22, spaced apart from each other by a predetermined distance and oriented in the direction of the y axis of the drawing.

The spacer loading region 12 for the spacer 10 may have a width A that is proportionate to the vertical pitch B of the unit pixels defined on the first substrate 2 or the second substrate 4. The width A of the spacer loading region 12 is the eccentric distance between two neighboring unit pixels, as measured in the direction of the y axis of the drawing.

With reference to FIG. 7, according to the present invention, the width A of the spacer loading region 12 is formed to correspond to the vertical pitch B of the unit pixels located along the width. Thus, according to the present invention, the width A and the vertical pitch B satisfy the following formula: the ratio A/B is greater than or equal to about 0.2. That is, $$A/B \geqq \text{about } 0.2 \quad \text{(Formula 1).}$$

Further, according to the present invention, the width A and the vertical pitch B preferably also satisfy the following formula: the ratio A/B is less than or equal to about 0.5. That is, $$A/B \leqq \text{about } 0.5 \quad \text{(Formula 2).}$$

For reference, as illustrated in FIG. 7, one phosphor layer 22 is provided for the respective unit pixels, and the vertical pitch of the phosphor layer 22 is indicated by B.

Figure 9:
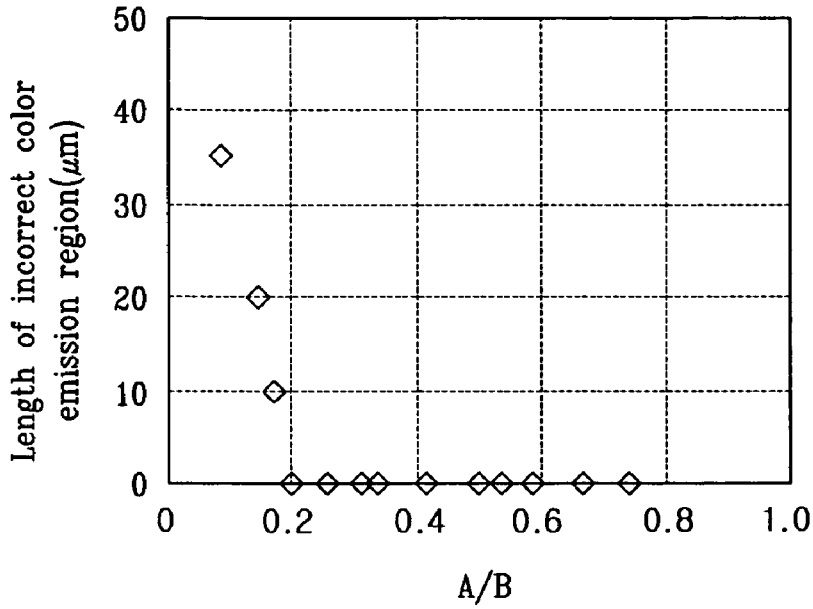
FIG. 9 illustrates a graph of the relationship between the ratio of the width of the spacer loading region to the vertical pitch of the unit pixels and the length of the incorrect color emission region.
Figure 10:
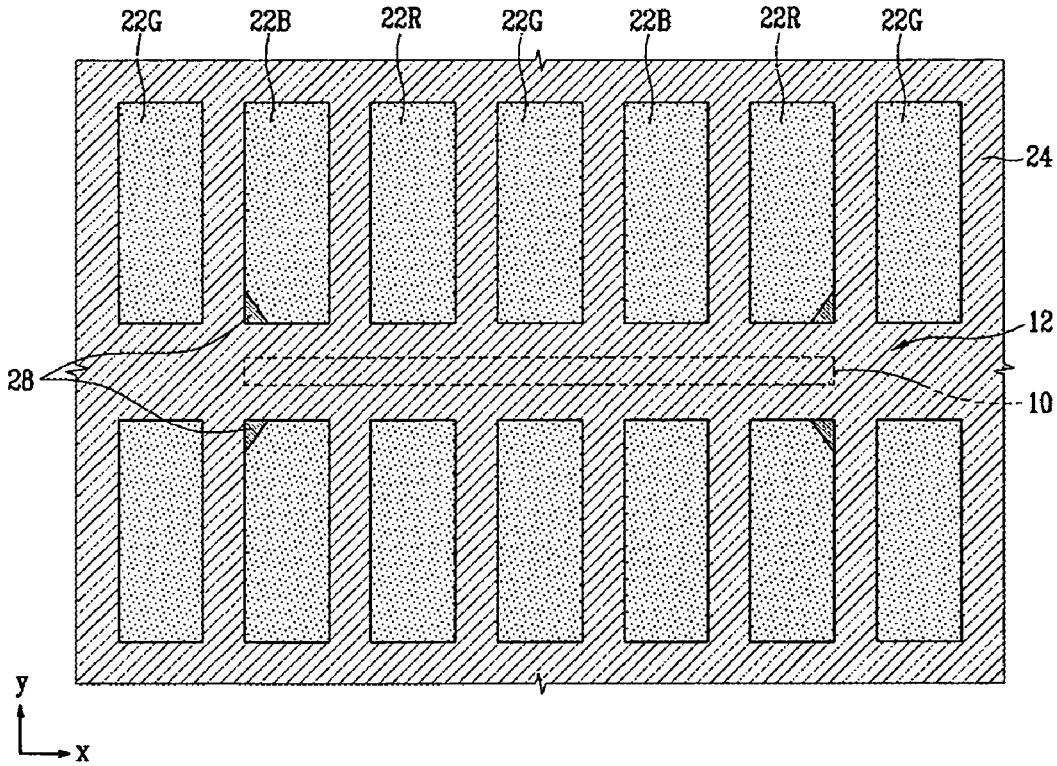
FIG. 10 illustrates a partial plan view of the incorrect color emission region of an electron emission device.

FIG. 9 illustrates a graph of the ratio A/B (the ratio of the width A of the spacer loading region 12 to the vertical pitch B of the unit pixels) in relation to the length of regions of light-emitting incorrect color phosphor layers (referred to hereinafter simply as the "incorrect color emission region"). As illustrated in FIG. 10, the incorrect color emission region means that the electrons emitted from the electron emission region toward a target unit pixel travel instead to incorrect color phosphor layers at pixels neighboring the target unit pixel, causing unwanted visible light emission. Reference numeral 28 of FIG. 10 refers to the incorrect color emission region.

As illustrated in FIG. 9, the vertical axis of the graph indicates the length of the incorrect color emission region measured in a direction of the second substrate (in the direction of the y axis of FIG. 10). For the illustrated results, the horizontal width of the phosphor layer was 130 μm, the width of the spacer was 70 μm and only the green phosphor layer was targeted. As illustrated, the length of the incorrect color emission region was measured according to varying widths A of the spacer loading region 12.

As illustrated in FIG. 9, incorrect color emission occurs when the ratio A/B of the width A of the spacer loading region 12 to the vertical pitch B of the unit pixels is less than about 0.2. As the ratio A/B becomes smaller, the length of the incorrect color emission region becomes larger.

During operation of the electron emission device, if electrons collide against the surface of the spacers 10, the spacers 10 may become surface-charged and distort the trajectories of electron beams passing around them. Thus, when the ratio A/B is less than about 0.2, the spacers 10 may be positioned too close to the phosphor layers, such that distortion of electron beams around the spacers causes the incorrect color emission. Note, however, that the present invention is not limited to this theory of operation.

In contrast, for electron emission devices according to this embodiment of the present invention, wherein the ratio A/B is greater than or equal to about 0.2, the electron beams are not distorted beyond the spacer loading region and the incorrect color emission is prevented.

When the ratio A/B is greater than or equal to about 0.2, incorrect color emission may be effectively prevented. However, if the ratio A/B is greater than about 0.5, the area of the phosphor layers with respect to the second substrate may be reduced to the extent that the luminance of the display deteriorates.

Figure 11:
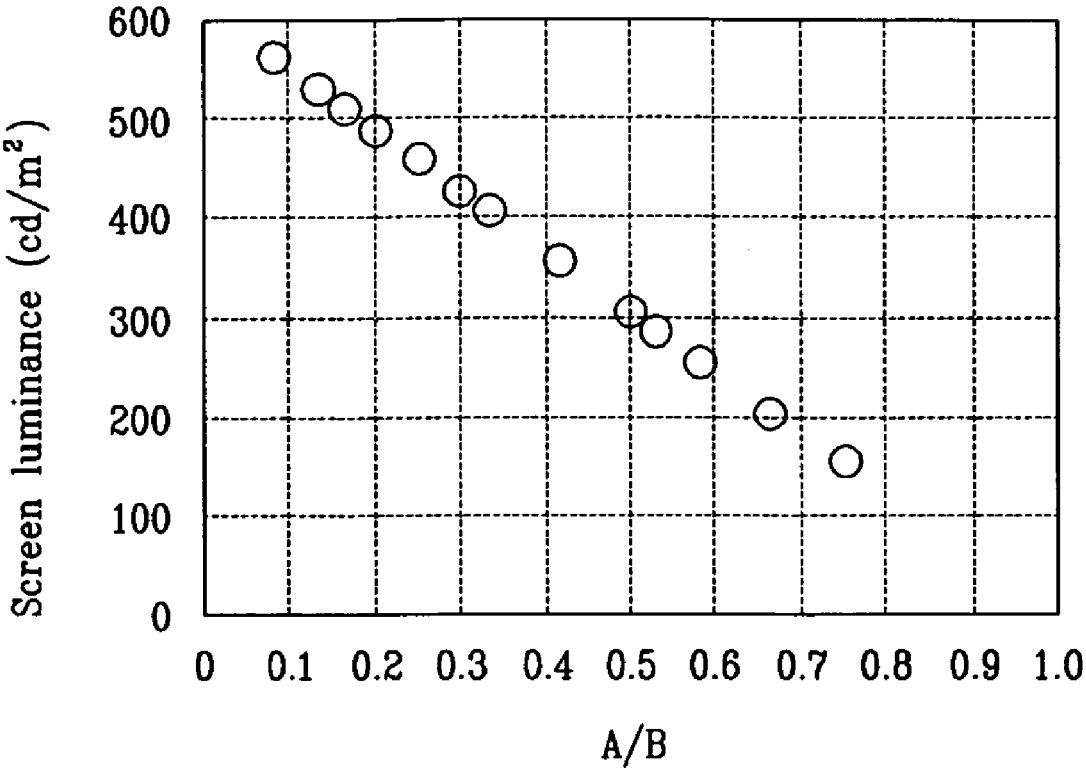
FIG. 11 illustrates a graph of the relationship between the ratio of the width of the spacer loading region to the vertical pitch of the unit pixels and the screen luminance.

FIG. 11 illustrates a graph of the ratio A/B in relation to the luminance. For the illustrated results, the current density was 0.0304 A/m$^2$ and the anode electric field was 3.06 V/μm. As illustrated in FIG. 11, a luminance of 300 cd/m$^2$ or more may be obtained with electron emission devices according to this embodiment of the present invention, wherein the ratio A/B is less than or equal to about 0.5.

As described above, with the electron emission device according to this embodiment of the present invention, the ratio A/B of the width A of the spacer loading region 12 to the vertical pitch B of the unit pixels is such that a high luminance screen can be obtained without causing incorrect color emission. Thus, the use of electron emission devices according to this embodiment of the present invention may prevent deterioration of screen image quality due to the charging of the spacers and may result in increased luminance of the resulting display.

The above explanation has been provided in the context of an FEA type electron emission device, wherein electron emission regions are formed of a material that emits electrons upon application of an electric field. However, the present invention is not limited to FEA type electron emission devices and may be applied to other cold cathode electron emission devices having electron emission sources, phosphor layers and spacers.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An electron emission device comprising:

first and second substrates facing each other, unit pixels being defined on the first and the second substrates;

an electron emission unit on the first substrate;

phosphor layers on a surface of the second substrate facing the first substrate, each phosphor layer corresponding to at least one unit pixel, the unit pixels being arranged such that phosphor layers corresponding to like colors are aligned along a first direction of the second substrate;

non-light emission regions between the phosphor layers; and spacers interposed between the first and the second substrates and arranged in the non-light emission regions, wherein the non-light emission regions include spacer loading regions loaded with the spacers and the spacers are disposed between the phosphor layers located along the first direction of the second substrate, wherein a width of the spacer loading region and a pitch of the unit pixels satisfy the following condition:

A/B is less than 0.5 and greater than or equal to about 0.2 where A indicates the width of the spacer loading region and B indicates the pitch of the unit pixels located along the width of the spacer loading region, with the width of the spacer loading region and the pitch of the unit pixels being determined along the first direction of the second substrate.

2. The electron emission device as claimed in claim 1, wherein black layers are formed at the non-light emission regions.

3. The electron emission device as claimed in claim 1, wherein the spacers have a wall shape.

4. The electron emission device as claimed in claim 1, wherein the spacers have a pillar shape.

5. The electron emission device as claimed in claim 1, wherein A/B is less than or equal to 0.49 and greater than or equal to about 0.2.

6. The electron emission device as claimed in claim 2, wherein the width of the spacer loading region corresponds to a width of a black layer.

7. A display device, comprising:

a first substrate including electron emission elements;

a second substrate facing the first substrate, the second substrate including a regular pattern arranged in a first direction, the regular pattern having spacer loading regions disposed between adjacent light emission regions, the spacer loading regions having a first length in the first direction and the light emission regions having a second length in the first direction, wherein the regular pattern has a pitch in the first direction equal to the sum of the first length and the second length, and wherein the first length is less than 0.5 and greater than or equal to about 0.2 of the pitch; and spacers disposed in the spacer loading regions.

8. The display device as claimed in claim 7, wherein the pitch corresponds to a vertical direction of the display device.

9. The display device as claimed in claim 7, wherein each light emission region comprises three different colored-light emission elements arranged in a second direction, the second direction substantially orthogonal to the first direction.

10. The display device as claimed in claim 7, further comprising non-light emission regions corresponding to the spacer loading regions.

11. The display device as claimed in claim 9, wherein the second direction corresponds to a horizontal direction of the display device.

12. The display device as claimed in claim 10, wherein the non-light emission regions are black layers.

13. A method of manufacturing a display device, comprising:

forming phosphor layers on a surface of a substrate, each phosphor layer corresponding to at least one unit pixel, the forming of the phosphor layers being such as to effect arrangement of the unit pixels so that phosphor layers corresponding to like colors are aligned alone a first direction of the substrate;

forming non-light emission regions between the phosphor layers; and arranging spacers in spacer loading regions between the phosphor layers located along the first direction of the substrate, the spacer loading regions located in the non-light emission regions, the arranging of the spacers in spacer loading regions such that a width of a spacer loading region and a pitch of the unit pixels satisfy the following condition:

A/B is less than 0.5 and greater than or equal to about 0.2 where A indicates the width of the spacer loading region and B indicates the pitch of the unit pixels located along the width of the spacer loading region, with the width of the spacer loading region and the pitch of the unit pixels being determined alone the first direction of the substrate.

14. The method as claimed in claim 13, further comprising forming black layers at the non-light emission regions.

15. The method as claimed in claim 13, wherein A/B is less than or equal to 0.49 and greater than and or equal to about 0.2.

16. The method as claimed in claim 4, wherein the width of the spacer loading region corresponds to a width of a black layer.

17. An electron emission device, comprising:

first and second substrates facing each other;

unit pixels arranged in a first direction, each unit pixel including a red, a green, and a blue phosphor layer arranged along a second direction substantially orthogonal to the first direction on a surface of the second substrate facing the first substrate;

an electron emission unit on the first substrate;

spacer loading regions between adjacent unit pixels; and spacers interposed between the first and the second substrates and arranged in spacer loading regions, wherein:

a width A of a spacer loading region measured in the first direction and a pitch B of the unit pixels measured in the first direction satisfy the following condition: A/B is less than 0.5 and greater than or equal to about 0.2, and the pitch B includes the width A and a width of the phosphor layers measured in the first direction.

* * * * *